United States Patent [19]

Andreetta

[11] Patent Number: 4,860,659

[45] Date of Patent: Aug. 29, 1989

[54] TUBULAR SHELL FOR ARTILLERY PROJECTILES

[75] Inventor: Rodolfo Andreetta, Montebelluna, Italy

[73] Assignee: Simmel Difesa S.p.A., Treviso, Italy

[21] Appl. No.: 181,230

[22] Filed: Apr. 13, 1988

Related U.S. Application Data

[63] Continuation-in-part of Ser. No. 889,938, Jul. 9, 1986, abandoned.

[30] Foreign Application Priority Data

Nov. 14, 1984 [IT] Italy ..... 23581 A/84

[51] Int. Cl.[4] ..... F42B 13/12

[52] U.S. Cl. ..... 102/473; 29/1.2; 102/491; 102/517

[58] Field of Search ..... 102/334, 364, 340, 342, 102/351, 357, 473, 474, 491, 493, 494, 495, 496, 501, 505, 517; 29/1.2–1.23

[56] References Cited

U.S. PATENT DOCUMENTS

| | | | |
|---|---|---|---|
| 1,971,433 | 8/1934 | Tartrais | 29/DIG. 26 X |
| 3,148,953 | 9/1964 | Goto | 228/175 X |
| 3,485,171 | 12/1969 | Wessells | 102/334 |
| 4,011,818 | 3/1977 | Stosz, Jr. et al. | 102/481 |
| 4,167,140 | 9/1979 | Biserod | 102/517 |

FOREIGN PATENT DOCUMENTS

| | | |
|---|---|---|
| 339776 | 11/1977 | Australia . |
| 26123 | 4/1883 | Fed. Rep. of Germany . |
| 1327972 | 4/1963 | France . |

*Primary Examiner*—Harold J. Tudor

*Attorney, Agent, or Firm*—Amster, Rothstein & Ebenstein

[57] ABSTRACT

The tubular shell comprises: a casing having a fuse-carrying forward portion, a substantially cylindrical intermediate portion formed with an inside undercut delimited by a rear shoulder and a front shoulder, and a tapered rear portion; a base plug received in the rear portion; at least three pre-formed, rigid segments of a cylindrical liner, received in the undercut so that they abut both shoulders, each segment being of a cross-section smaller than the aperture of the casing in its rear portion. The backs of the segments are relieved to provide desired weight and/or other inertial properties. A narrow wedge is used as a final restraining segment.

3 Claims, 1 Drawing Sheet

TUBULAR SHELL FOR ARTILLERY PROJECTILES

This application is a continuation-in-part of U.S. patent Ser. No. 889,938, filed July 9, 1986 now abandoned.

This invention relates to a tubular shell for artillery projectiles for use in rifled barrels, and more specifically to a shell having a casing cast in one piece. The shell is intended as a carrier of an internal canister or load, of an illuminating or smoke producing or deflagrating type, the ejection from the projectile and the operation of the load being activated by suitable, known pyrotechnic and mechanical devices.

In order to reduce the weight of a tubular shell of a given size while keeping unaffected the mass in the larger diameters, so as to increase the stability of the overall projectile, it is known in the prior art to machine an undercut in the internal surface of the tubular shell, and to insert liners of a lighter material in the undercut. The purpose of the liner is to keep to a cylindrical shape the internal chamber, so as to provide a continuous guide to the internal load, or canister, of the projectile during the ejection movement. The liner itself is also intended to keep or adjust the weights of the assembly to within expected tolerances.

However, where the casing of the shell is made in one piece, it has not been possible to insert a prepared liner in the casing, and therefore the liner has been expensively spin-cast into the undercut, and the internal surface of the liner has then had to be machined again to obtain a desired diameter.

Moreover, with such prior art liners the weight and center of gravity of the shell could not be easily adjusted, for a given internal diameter of the shell, except by changing the material of the liner. This has been a serious limitation.

The main object of this invention is therefore to provide a tubular shell for artillery projectiles of the above-mentioned type, which has the desired ballistic properties, which has an internal volume optimized to suit the contents for which it is intended, minimum stresses and strains and minimum weight with respect to those provided by the present state of the art, and which in addition is inexpensive to manufacture.

Another object of the invention is to provide a shell of the above type, which can be readily adjusted to different requirement of weight, inside diameter, moment of inertia, etc., starting from a standard casing, largely independently of the outside diameter of the casing.

Another object is to provide a shell which can be easily converted, if necessary, to a different load, even after assembly.

This object as well as others stated below are attained according to the invention by providing a tubular shell for artillery projectiles, comprising:

a casing having a fuse-carrying forward portion, a substantially cylindrical intermediate portion formed with an inside undercut delimited by a rear shoulder and a front shoulder, and a tapered rear portion;

a base plug received in the rear portion;

at least three pre-formed, rigid segments of a cylindrical liner, received in the undercut so that they abut both shoulders, each segment being of a cross-section smaller than the aperture of the casing in its rear portion.

The invention will be better understood from the following description, given merely as a nonlimiting example of an embodiment thereof, with reference to the accompanying drawings, in which.

Figure 1:
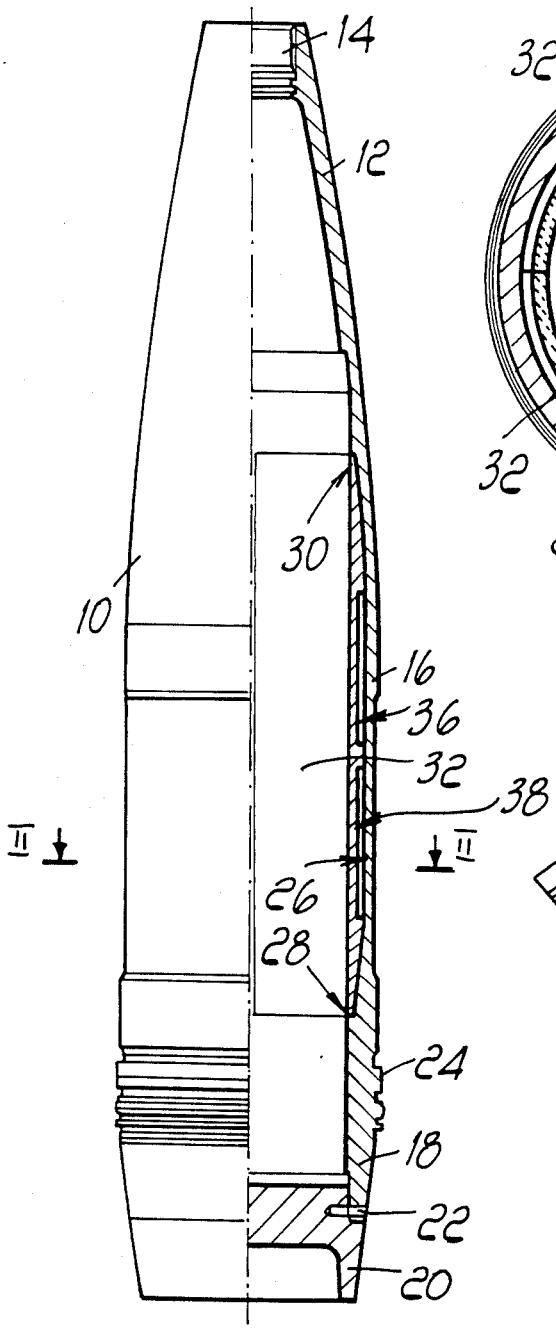
FIG. 1 is a longitudinal, partially broken-away view of a tubular shell for artillery projectiles according to the invention.
Figure 2:
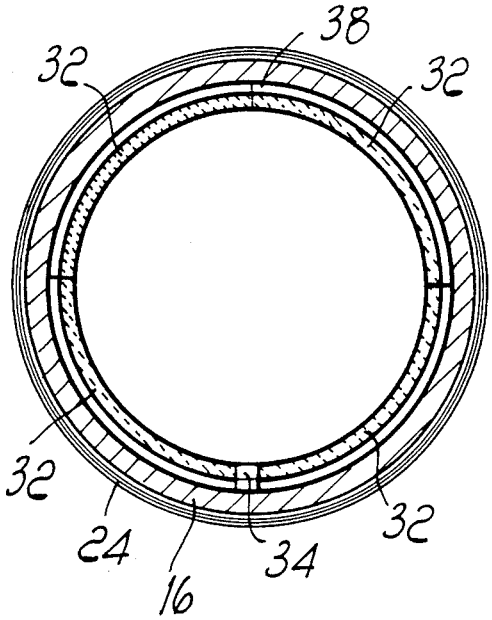
FIG. 2 is an enlarged, transverse cross-sectional view, along line II–II of FIG. 1, of the tubular shell of FIG. 1.
Figure 3:
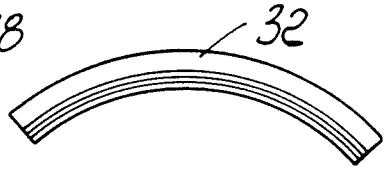
FIG. 3 is an end view of a common segment of a liner used in the shell of FIGS. 1 and 2.
Figure 4:
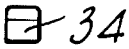
FIG. 4 is an end view of a filler segment of a liner used in the shell of FIG. 1 and 2.

With reference to the Figures, a shell according to the invention comprises a hollow casing 10 cast as a single piece of high-resistance steel. After casting, the casing 10 is machined by conventional means to have a nose-shaped forward portion 12 provided with a threaded fitting 14 for a fuse (not shown), a central cylindrical portion 16 providing a guide during motion of the shell in a gun barrel, and with an open, tapered rear portion 18, provided with a base plug 20 that is retained in a conventional manner by means of pins 22. The tubular shell 10 is provided with a gas-retaining, soft-metal band 24, known to those skilled in the art and therefore not further described.

In the internal surface of central cylindrical portion 16 of tubular shell 10, an undercut 26 is made, delimited by a rear shoulder 28 at the end of the undercut facing the end plug 20, and a front shoulder 30 at the end of the undercut facing the nose-shaped portion 12.

Four identical cylindrical segments 32, made of a light, rigid metal such as an aluminum alloy, each extend thru an arc of about a quarter of a cylinder and each have an internal, concave cylindrical surface and an external, convex surface that is relieved in one or more annuli such as 36, 38. The four segments 32 are of a size allowing them to pass thru the aperture in the rear portion 18, and are placed side by side in mutual abutting relationship within the undercut 26 to form a liner for the shell, and their length is such that they also abut both the rear and the front shoulders of the undercut.

In order for the segments 32 to be capable of being placed side by side against the wall of the casing, they must be slightly narrower than a full quarter cylinder (otherwise the fourth segment would not pass the edges of the other three). Therefore, a thin filler segment, or wedge, 34 is inserted in the remaining narrow place at the end of the assemblage, to keep in position the other four segments and to form a complete, flush cylindrical surface.

Different segments, having a different inside curvature and/or a different relief on the outside surface, can be used for a given casing, so that the same casing can give rise to a different internal diameter, or a different weight or moment of inertia of the shell, depending on the size, weight and center of gravity of the load. Thus the same casing can be used for illumination, ammunition, etc., the differences of the loads being compensated by the liner.

Also, if necessary, a finished projectile can be dismantled and the casing reused with a different load, by taking apart the liner and replacing it with a more suitable one.

The segments of the liner rest against shoulder 28, whose area is chosen such as to resist the pressures exerted by the segments during firing of the projectile.

The segments may be further secured to casing 10 by suitable means such as by glue or rivets, or by means of screws or other means known per se.

Thanks to the arrangements provided by the invention, a weight reduction of the tubular shell body of the projectile, an increase of its strength thanks to the elimination of joints, and a cost reduction in terms of machining times and material can be achieved at the same time.

I claim:

1. A tubular shell for artillery projectiles, comprising:

a casing having a fuse-carrying forward portion, a substantially cylindrical intermediate portion formed with an inside undercut delimited by a rear shoulder and a front shoulder, and a tapered rear portion defining an aperture;

a base plug received in the rear portion;

at least three pre-formed, rigid segments of a cylindrical liner, received in the undercut so that they abut both shoulders, each segment being of a cross-section smaller than the aperture of the casing in its rear portion.

2. The shell of claim 1, wherein the segments are five in number, four of the segments being of equal size, and the remaining sect or being a narrow wedge.

3. The shell of claim 1, wherein the segments are each relieved in their convex surface.

* * * * *